US005868369A

United States Patent [19]

Montgomery

[11] Patent Number: 5,868,369

[45] Date of Patent: Feb. 9, 1999

[54] HANGER HOLDER

[76] Inventor: Kevin D. Montgomery, 2448 Piney Grove Church Rd., Knoxville, Tenn. 37921

[21] Appl. No.: 792,976

[22] Filed: Feb. 3, 1996

[51] Int. Cl.[6] ..... A47G 29/00

[52] U.S. Cl. ..... 248/214; 24/298; 24/306; 248/317; 248/505

[58] Field of Search ..... 248/205.2, 505, 248/317, 214; 224/250, 675, 927; 24/298, 300–302, 442, 306, DIG. 29, 3.13

[56] References Cited

U.S. PATENT DOCUMENTS

| | | | |
|---|---|---|---|
| 289,700 | 12/1883 | Parker . | |
| 852,180 | 4/1907 | Hoffman | 5/498 X |
| 1,490,066 | 4/1924 | Carr | 24/302 X |
| 3,193,235 | 7/1965 | Jensen | 248/317 |
| 3,657,774 | 4/1972 | Reynolds | 24/298 |
| 3,972,133 | 8/1976 | Parshall | 35/26 |
| 4,088,290 | 5/1978 | Novello | 248/118.5 |
| 4,188,006 | 2/1980 | Karlin | 248/118.3 |
| 4,685,644 | 8/1987 | Yates | 248/118.3 |
| 4,863,083 | 9/1989 | Chen | 224/250 X |
| 4,963,410 | 10/1990 | Bryant | 24/306 X |
| 4,982,885 | 1/1991 | Severson et al. | 224/675 |
| 5,008,987 | 4/1991 | Armour, II | 24/306 X |
| 5,075,933 | 12/1991 | Kemper | 24/306 X |
| 5,141,198 | 8/1992 | Hoyt | 248/441.1 |
| 5,172,883 | 12/1992 | Amirian | 248/441.1 |
| 5,193,772 | 3/1993 | Johnston | 248/118.5 |
| 5,299,772 | 4/1994 | Weber | 248/441.1 |
| 5,425,485 | 6/1995 | Carlo | 24/298 X |
| 5,459,903 | 10/1995 | Treacy | 24/301 X |
| 5,511,756 | 4/1996 | Spradling | 24/306 X |

*Primary Examiner*—James R. Brittain
*Attorney, Agent, or Firm*—Pitts & Brittian, P.C.

[57] ABSTRACT

A hanger holder provided for being carried on a conventional laundry basket and for carrying a plurality of conventional clothes hangers in such a manner as to not allow any of the hangers to fall therefrom, and such that the hangers retained thereby are prevented from becoming entangled one with another. The hanger holder of the present invention includes at least two loop members secured to each other or to a base. Each loop member is provided with a fastener for fastening the distal end thereof to either the proximal end of one of the loops, or to the base. In one embodiment, a first loop is provided for being mounted on a conventional laundry basket, a wire-type shelving unit, or a clothes rod in a closet. Second and third loops are provided for encircling either side of at least one conventional hanger, with the hook of each hanger being disposed between the second and third loops. In an alternate embodiment of the hanger holder of the present invention, first and second loop members are secured to a ring member. The distal ends of each loop member are received through an opening in the laundry basket, pulled over the basket and then received through the ring member. The distal end of each loop member is provided with a portion of a conventional fastener to facilitate securement to one or the other loop members.

4 Claims, 3 Drawing Sheets

HANGER HOLDER

TECHNICAL FIELD

This invention relates to an implement used while cleaning laundry. More specifically, this invention relates to a device for organizing and holding a group of clothing hangers on a laundry basket.

BACKGROUND ART

In the field of laundry, it is well known that when one transports dirty laundry to be washed, hangers are also carried to hang up the clean clothes. However, due to their design, hangers are typically difficult to manage. Especially true for wire hangers, they become entangled with each other when they are grouped together and then released. For instance, many people place the hangers on top of their laundry basket when preparing to take the laundry into a laundry room, or for those without a laundry room, to a laundromat. When the basket is not full, the only problem may be the entanglement of the hangers. However, if the basket is full or overflowing, the hangers will also tend to fall.

In order to avoid these problems, many people throw the hangers into container such as a bag which is then either placed on top of the laundry basket or is carried separately. However, the same problem with entanglement occurs which in turn makes it difficult to retrieve a single hanger. When one hanger is pulled from the bag, several other hangers entangled with the one are also pulled from the bag, with the potential of all of the hangers eventually being pulled from the bag and the mass of hangers being set aside as would be in the case where the hangers are simply thrown on top of the laundry in the laundry basket.

Many devices have been produced for carrying articles which are hanging on conventional clothes hangers. Typical of the art are those devices disclosed in the following U.S. Patents:

| U.S. Pat. No. | Inventor(s) | Issue Date |
|---|---|---|
| 2,609,104 | K. F. Leach | Sept. 2, 1952 |
| 3,907,118 | J. Y. Pelavin | Sept. 23, 1975 |
| 4,153,189 | A. F. Hughes | May 8, 1979 |
| 5,330,244 | D. C. Rodwell | July 19, 1994 |
| 5,509,632 | L. D. Mesna, et al. | Apr. 23, 1996 |

Of these devices, those disclosed by Leach ('104) and Pelavin ('118) are provided for holding clothes carried by conventional clothes hangers and are configured to be received over a closet rod, an automobile window, or other horizontal support member. These devices are elongate members supported at one end such that the device hangs downwardly. Individual receptors are defined along the elongate member for carrying one conventional clothes hanger each by receipt of the hook portion of the hanger. In the '104 device, the receptors are defined by a number of loops formed by bending a rod, while the '118 device includes a chain, with receptors being defined by individual links in the chain. Thus, when each receptor is filled, and the elongate member is carried at one end by, for example, a closet rod, the clothes hanging on each clothes hanger are held in close proximity to each other. The purpose for such a device is to conserve room required to store the clothing held on the clothes hangers.

Hughes ('189) and Rodwell ('244) both disclose device for retaining a plurality of clothes hangers as a group. Each of these devices provides a hook to facilitate carrying the device with hangers mounted thereon, and further to facilitate engagement of a support device such as a closet rod or a hook provided in an automobile for the placement of a hanger. Each of these devices is provided for carrying a plurality of hangers by receiving the hook portions thereof, as in the previously described devices. However, there is no provision for preventing the hangers from moving in relation to each other. However, because these devices are intended for carrying clothes which are carried on hangers, the weight of the clothes and the separation of the hangers as a result of the clothes obviates such a need.

That device disclosed by Mesna, et al. ('632) is a hook configured to be mounted on an inclined surface such as an individual link in a chain link fence. The '632 device illustrates a conventional "S"-type hook where an upper hook is configured to be received over a particular structure and the lower hook is configured to receive at least one item. For purposes of the present invention, it would be envisioned that a number of hangers may be carried by placing the hook portion of the hanger over the lower hook of the device.

However, in each of the devices disclosed above, the hook portion of the hanger is being engaged. A resulting problem is empty hangers are being carried is that there is a tendency for the hangers to move with respect to each other. As the hangers begin to move, some may tend to become disengaged from the device and fall. As disclosed, it can be seen how each device provides a useful function while carrying clothes which are carried on hangers, but such devices lose their utility when carrying empty hangers.

Therefore, it is an object of this invention to provide a means for carrying a plurality of hangers such that the hangers are prevented from becoming entangled with each other.

It is another object of the present invention to provide a device for carrying clothes hangers such that they may not become dislodged therefrom.

Still another object of the present invention is to provide a device for carrying clothes hangers in such a manner as to keep the hangers organized, while also providing a means for mounting the device on a clothes basket, therefore allowing for the transport of the hangers with laundry to make the hangers available to hang clean clothed thereon.

Yet another object of the present invention is to provide such a device wherein hangers may be removed therefrom without creating entanglement between the hangers.

DISCLOSURE OF THE INVENTION

Other objects and advantages will be accomplished by the present invention which is provided for being carried on a conventional laundry basket and for carrying a plurality of conventional clothes hangers in such a manner as to not allow any of the hangers to fall therefrom. Further, the hanger holder is designed such that the hangers retained thereby are prevented from becoming entangled one with another such that removal of the hangers when needed is simplified. Moreover, the hanger holder of the present invention may be mounted on a wire-type shelf commonly found in laundry rooms and closets for storage of extra hangers.

The hanger holder of the present invention includes at least two loop members secured to each other or to a base. Each loop member is provided with a fastener for fastening the distal end thereof to either the proximal end of one of the loops, or to the base. In one embodiment, a first loop is provided for being mounted on a conventional laundry basket, a wire-type shelving unit, or a clothes rod in a closet. When used in conjunction with a laundry basket or a wire-type shelving unit, the distal end of the first loop is received through an opening defined by laundry basket or shelf such that the loop encircles a portion of thereof Second and third loops are provided for encircling either side of at least one conventional hanger, with the hook of each hanger being disposed between the second and third loops. In the instant embodiment, the first loop member defines a strap, while the second and third loop members define elastomeric cords. The base is a ring on which the proximal end of each loop member is mounted. The proximal end of each of the second and third loop members is mounted on the ring in a conventional manner, such as by wrapping the distal end of the loop member around the ring and securing it to the loop member.

In an alternate embodiment of the hanger holder of the present invention, first and second loop members are secured to a ring member. The distal ends of each loop member are received through an opening in the laundry basket, pulled over the basket and then received through the ring member. The distal end of each loop member is provided with a portion of a conventional fastener to facilitate securement to one or the other loop members.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
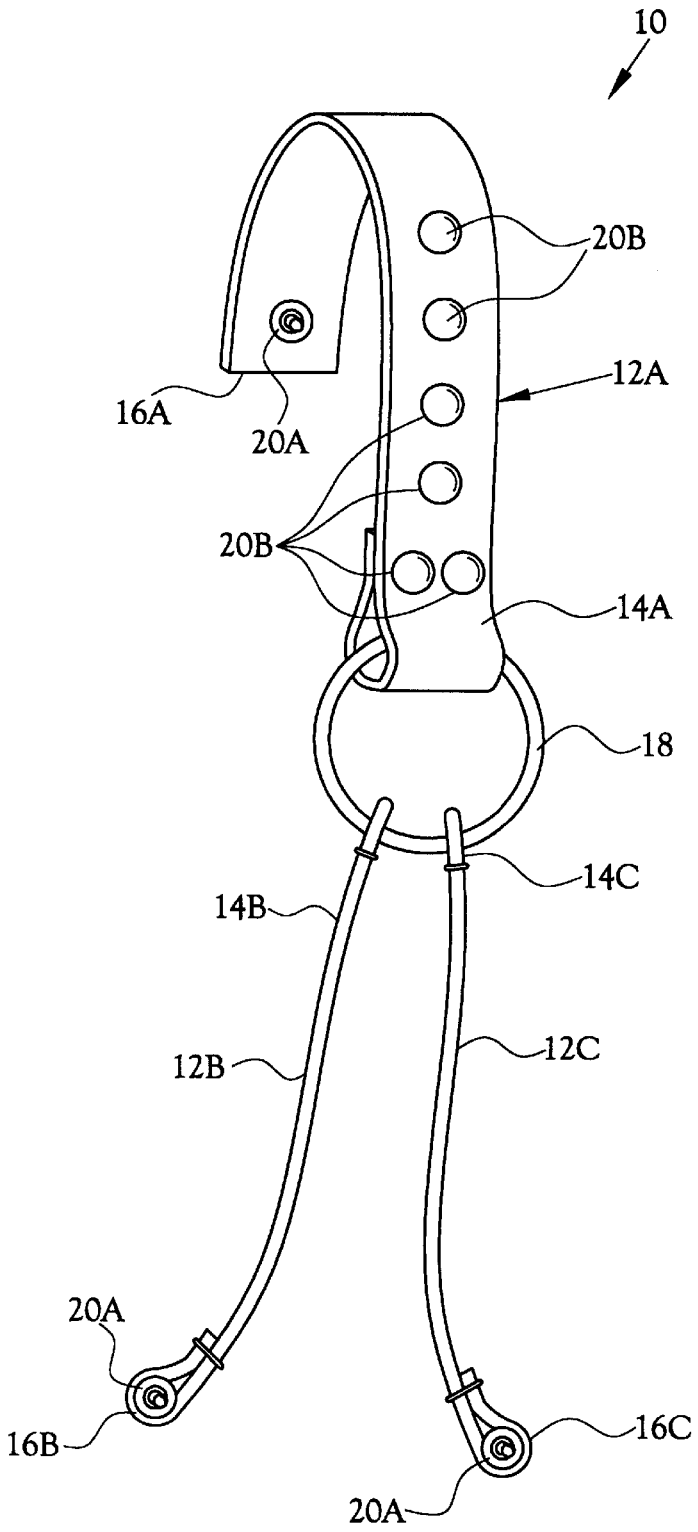
FIG. 1 is a perspective view of the hanger holder constructed in accordance with several features of the present invention.

A hanger holder incorporating various features of the present invention is illustrated generally at 10 in the figures. The hanger holder 10, is designed for being carried on a conventional laundry basket 30 and for carrying a plurality of conventional clothes hangers 34 in such a manner as to not allow any of the hangers 34 to fall therefrom. Further, the hanger holder 10 is designed such that the hangers 34 retained thereby are prevented from becoming entangled one with another such that removal of the hangers 34, when needed, is simplified. Moreover, the hanger holder 10 of the present invention may be mounted on a wire-type shelf commonly found in laundry rooms and closets for storage of extra hangers 34.

The hanger holder 10 of the present invention is comprised primarily of three loop members 12 secured to a base 18 at a proximal end 14 thereof. Each loop member 12 is provided with a fastener 20 for fastening the distal end 16 of the loop member 12 to either the proximal end 14 of one of the loop members 12, or to the base 18. A first loop member 12A is provided for being mounted on a conventional laundry basket 30, a wire-type shelving unit, or a clothes rod in a closet. In the situations where the hanger holder is used in conjunction with a laundry basket 30 or a wire-type shelving unit, the distal end 16 of the first loop member 12A is received through an opening 32 defined by laundry basket 30 or shelf such that the loop member 12A encircles a portion of thereof.

Figure 2:
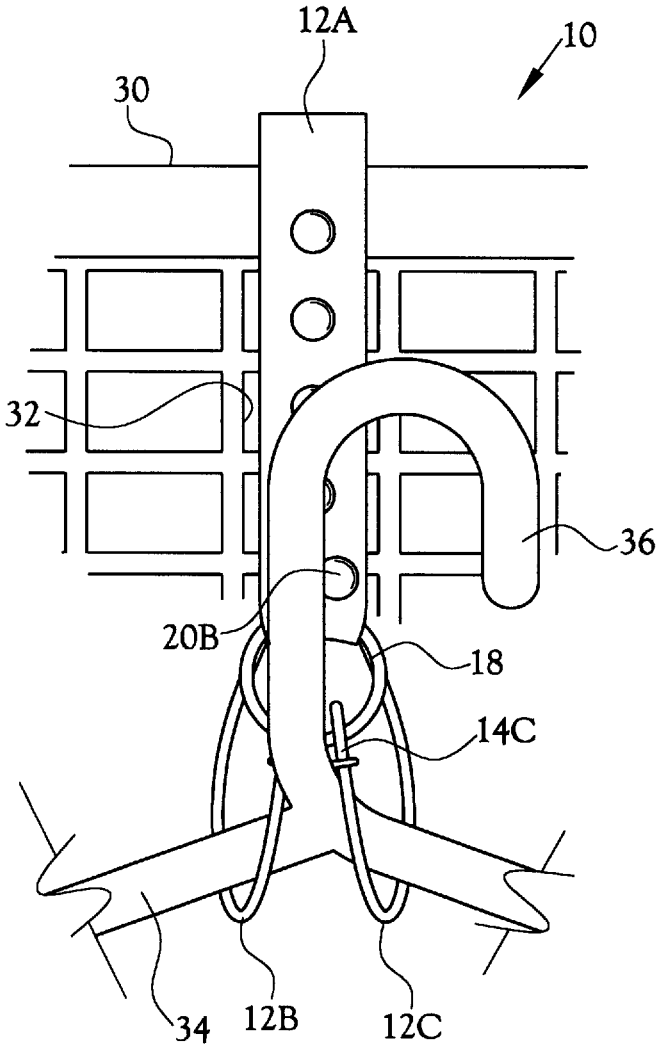
FIG. 2 illustrates an elevation view of the hanger holder of FIG. 1 shown mounted on a conventional laundry basket and retaining one conventional hanger.

Second and third loop members 12B, C are provided for encircling either side of at least one conventional hanger 34, with the hook 36 of each hanger 34 being disposed between the second and third loop members 12B, C. FIG. 2 illustrates the use of the hanger holder 10 to hold a hanger 34 on a conventional laundry basket 30. It will be seen from this figure that the disposition of a loop member 12B, C on either side of the hook 36 prevents the hanger 34 from rotating within the hanger holder 10. As a result, when a number of hangers 34 are retained therein, the hangers 34 are maintained together as a unit, thus preventing entanglement between the hangers 34.

In the embodiment illustrated in FIGS. 1 and 2, the first loop member 12A defines a strap, while the second and third loop members 12B, C define elastomeric cords. The base 18 is a ring on which the proximal end 14 of each loop member 12 is mounted. The fasteners 20 used by each of the loop members 12 are conventional snaps. The male portion 20A of a snap is carried by the distal end 16 of each of the three loop members 12. The first loop member 12A is mounted on the ring 18 by way of two female snap portions 20B, which are also used to cooperate with the male snap portions 20A carried by the distal end 16B, C of each of the second and third loop members 12B, C. A plurality of female snaps portions 20B are spaced along the first loop member 12A for cooperating with the first loop member male snap portion 20A, thus allowing for adjustment of the length of the first loop member 12A. The proximal end 14B, C of each of the second and third loop members 12B, C is mounted on the ring 18 in a conventional manner, such as by wrapping the distal end 16 of the loop member 12 around the ring 18 and securing it to the loop member 12.

Although illustrated and described in this manner, it will be understood that the present invention is not limited to a base member 18 defining a ring, a first loop member 12A defining a strap, second and third loop members 12B, C defining elastomeric cords, fasteners 20 being snaps, or the specific manners and locations at which the individual components are secured one to another. It is envisioned that, for example, the fasteners 20 may be hook-and-loop fasteners, buttons, clasps, or any other conventional fasteners, with the first, second and third loop members 12A, B, C being modified accordingly. Further, it is envisioned that each of the loop member proximal ends 14 may be sewn together, thus the combination of the three distal ends 14A, B, C defining the base member.

Figure 3:
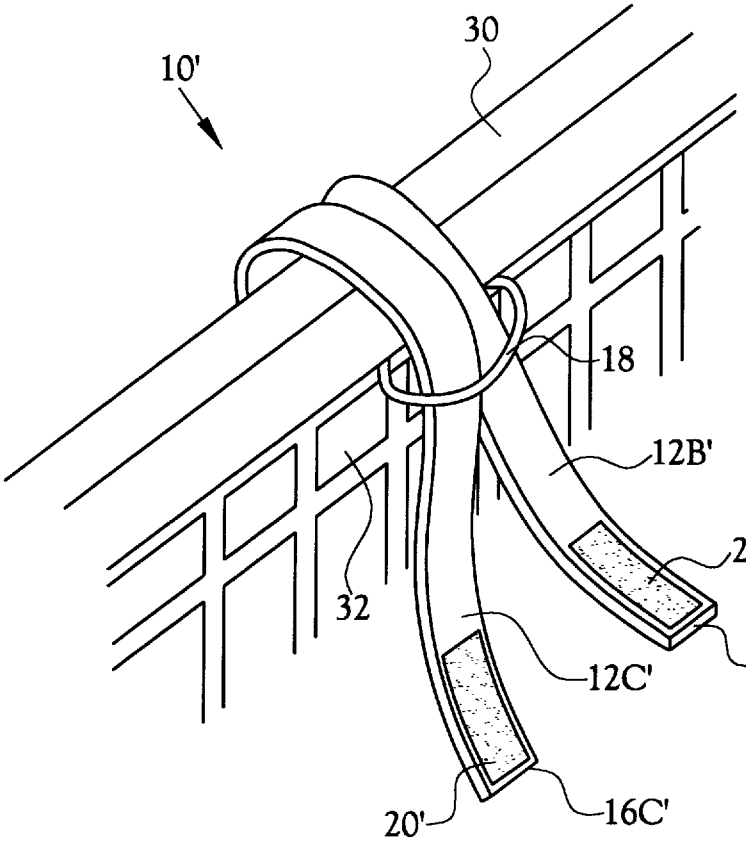
FIG. 3 is a perspective view of an alternate embodiment of the hanger holder of the present invention.

FIG. 3 illustrates an alternate embodiment of the hanger holder 10' of the present invention. In this embodiment, the hanger holder 10' is comprised generally of first and second loop members 12B', 12C' secured to a ring member 18. The distal ends 16' of each loop member 12' are received through an opening 32 in the laundry basket 30, pulled over the basket 30 and then received through the ring member 18. The distal ends 16' are provided with a portion of a conventional fastener 20' such as those mentioned above. In the illustrated embodiment, the distal end 16' of each loop member 12' is provided with one portion of a hook-and-loop fastener, with the loop member 12' itself being cooperative with that portion such that the distal end 16' of the loop member 12' may be secured at any point thereon. In the alternative, a cooperating portion of the hook-and-loop fastener may be secured at a selected location or over the entire length of the loop member 12' to accomplish a similar result. The loop members 12' are then disposed about the conventional hangers 34 as in the previous embodiment. It is envisioned that in this embodiment, the ring member 18 may be eliminated and the proximal ends 14' of each loop member 12' joined to form a single strap, with the middle portion thereof serving a similar function as the ring member 18.

From the foregoing description, it will be recognized by those skilled in the art that a hanger holder offering advantages over the prior art has been provided. Specifically, the hanger holder provides a device whereby at least one conventional hanger may be carried on a conventional laundry basket without risk of the hanger falling. The hanger holder also provides a device whereby a plurality of hangers may be carried without the hangers becoming entangled one with another. When used in closets or in association with wire-type shelving such as in a laundry room, the hanger holder of the present invention provides a means whereby a plurality of hangers may be neatly organized and stored.

While preferred embodiments have been shown and described, it will be understood that they are not intended to limit the disclosure, but rather are intended to cover all modifications and alternate methods falling within the spirit and the scope of the invention as defined in the appended claims.

Having thus described the aforementioned invention, I claim:

1. A hanger holder adapted to be mounted on a conventional laundry basket, the laundry basket defining at least one opening proximate an upper edge thereof, said hanger holder for carrying at least one conventional clothes hanger having a centrally-located hook and a pair of side members extending in opposite directions from the hook, said hanger holder comprising:

a base member including at least a ring member;

first and second loop members, each of said first and second loop members being adapted to be received around one of said pair of hanger side members, each of said first and second loop members being secured at a proximal end to said base member;

a third loop member configured to be received within the opening defined by the laundry basket, said hanger holder further comprising a third fastener for fastening said third loop member around a portion of the laundry basket when received through the laundry basket opening, said base member further including said third loop member, said first, second and third loop members being secured at a proximal end thereof to said ring member; and first and second fasteners for respectively fastening a distal end of each of said first and second loop members in a releasable fashion to said base member such that said first and second loop members are adapted to be received around each of said pair of hanger side members, each of said first and second loop members defining an elongated member, a first portion of each of said first and second fasteners being carried by said first and second loop members, respectively, at said distal end thereof, and wherein a second portion of said first and second fasteners is carried by said proximal end of said third loop member.

2. The hanger holder of claim 1 wherein said base member is defined by a combination of a proximal end of each of said first and second loop members, each said proximal end being secured one to another.

3. The hanger holder of claim 1 wherein said first and second fastners are selected from a group consisting of at least a snap, a button, a hook-and-loop type fasterer, a clasp.

4. The hanger holder of claim 2 wherein said first and second fasterners are selected from a group consisting of at least a snap, a button, a hook-and-loop type fasterner, a clasp.

* * * * *